US009895012B2

(12) United States Patent
Jones

(10) Patent No.: US 9,895,012 B2
(45) Date of Patent: Feb. 20, 2018

(54) PILLOW DECORATION SYSTEM

(71) Applicant: Sharon Jones, Fort Worth, TX (US)

(72) Inventor: Sharon Jones, Fort Worth, TX (US)

( * ) Notice: Subject to any disclaimer, the term of this patent is extended or adjusted under 35 U.S.C. 154(b) by 207 days.

(21) Appl. No.: 15/002,069

(22) Filed: Jan. 20, 2016

(65) Prior Publication Data

US 2017/0202377 A1 Jul. 20, 2017

(51) Int. Cl.
*A47G 9/10* (2006.01)
*A47G 9/00* (2006.01)

(52) U.S. Cl.
CPC ..... *A47G 9/1045* (2013.01); *A47G 2009/005* (2013.01)

(58) Field of Classification Search
CPC ..... A47G 9/00; A47G 9/10; A47G 9/1045; A47G 2009/005; A47C 31/026; F16B 35/04; F16B 35/041; F16B 35/044; F16B 35/048
USPC ..... D6/600, 601
See application file for complete search history.

(56) References Cited

U.S. PATENT DOCUMENTS 1,814,966 A * 7/1931 Rosenberg ..... A47G 3/00 24/113 MP
2,013,528 A * 9/1935 Thiele ..... A47C 31/026 24/102 T
2,802,297 A * 8/1957 Meyer ..... B68G 7/08 24/102 T
3,341,905 A * 9/1967 Reva ..... A44B 1/28 24/105
3,378,054 A * 4/1968 Vaughn ..... F16B 4/0208 411/106
3,603,626 A * 9/1971 Whiteside ..... F16B 5/02 403/408.1
4,267,615 A * 5/1981 Nealy ..... B63B 35/7933 24/104
4,972,533 A * 11/1990 Brown ..... A47G 9/0207 362/800
5,070,558 A 12/1991 Fenley
5,400,230 A 3/1995 Nicoletti
D366,176 S 1/1996 Gish
6,109,761 A * 8/2000 Smith ..... F21L 15/08 362/108
6,158,451 A * 12/2000 Wu ..... A45B 3/04 135/16
6,859,964 B1 * 3/2005 Arnott ..... A47C 20/00 5/636
7,172,308 B1 * 2/2007 Su ..... A45B 3/04 200/317
D552,913 S * 10/2007 Boutin ..... D6/601
7,520,633 B2 * 4/2009 Hornsby ..... A47B 97/00 362/231
7,815,435 B2 10/2010 Riley
D629,240 S 12/2010 Egan
D712,681 S * 9/2014 Del Russo, Jr. ..... D6/600
2007/0053767 A1 * 3/2007 Chen ..... F16B 37/14 411/429
2008/0080955 A1 * 4/2008 Liu ..... F16B 37/14 411/429

(Continued)

*Primary Examiner* — Nicholas F Polito

(57) ABSTRACT

A pillow decoration system includes a pillow that has a front side and a back side. A lighting unit is removably coupled to the pillow and the lighting unit enhances an ornamental appearance of the pillow. A decoration is selectively positioned on the lighting unit and the decoration enhances an ornamental appearance of the pillow.

9 Claims, 5 Drawing Sheets

(56) References Cited

U.S. PATENT DOCUMENTS

| | | | | |
|---|---|---|---|---|
| 2009/0094751 | A1 | 4/2009 | Phillimore | |
| 2009/0098316 | A1* | 4/2009 | Cox | A47C 31/026 428/28 |
| 2011/0094009 | A1 | 4/2011 | Landry | |
| 2016/0069375 | A1* | 3/2016 | Henricksen, Jr. | F16L 35/01 411/223 |

* cited by examiner

PILLOW DECORATION SYSTEM

BACKGROUND OF THE DISCLOSURE

Field of the Disclosure

The disclosure relates to decoration devices and more particularly pertains to a new decoration device for enhancing an ornamental appearance of a pillow.

SUMMARY OF THE DISCLOSURE

An embodiment of the disclosure meets the needs presented above by generally comprising a pillow that has a front side and a back side. A lighting unit is removably coupled to the pillow and the lighting unit enhances an ornamental appearance of the pillow. A decoration is selectively positioned on the lighting unit and the decoration enhances an ornamental appearance of the pillow.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
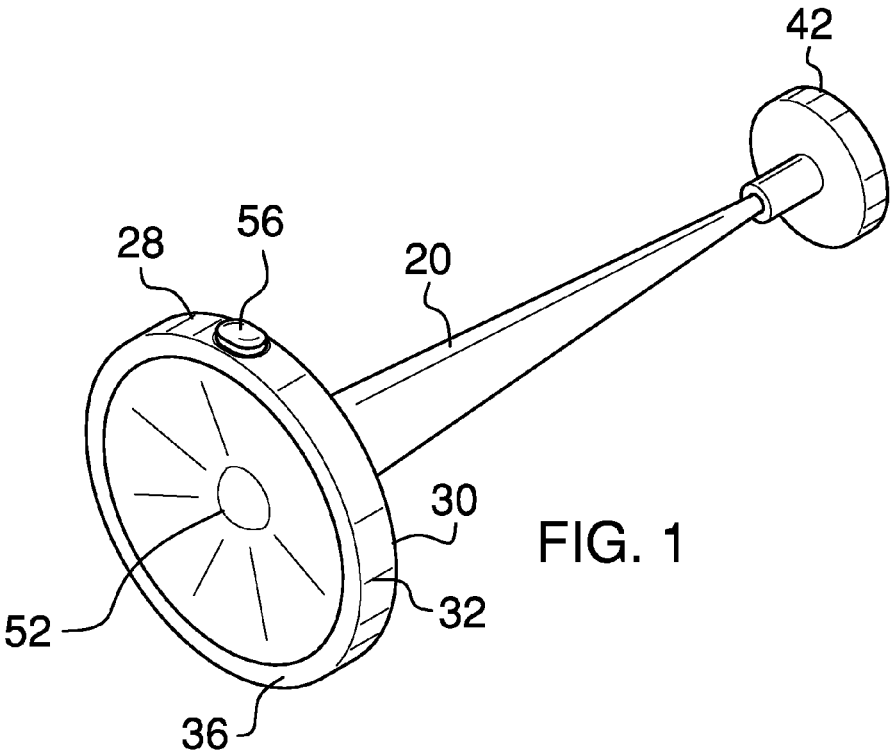
FIG. 1 is a perspective view of a pillow decoration system according to an embodiment of the disclosure.
Figure 2:
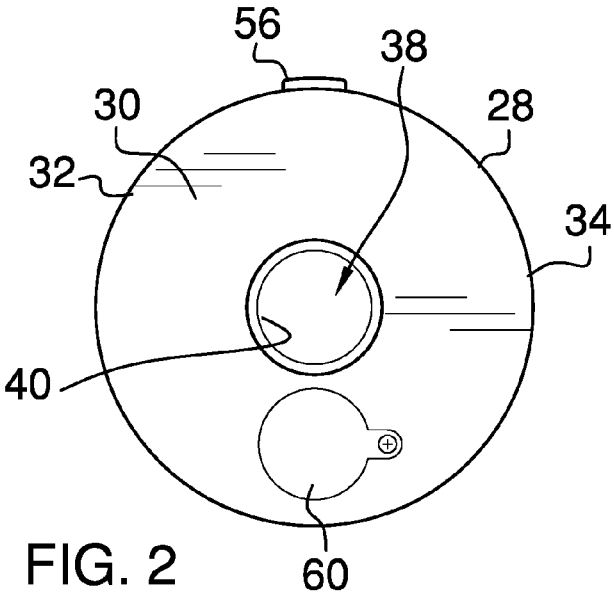
FIG. 2 is a back view of a disk of an embodiment of the disclosure.
Figure 3:
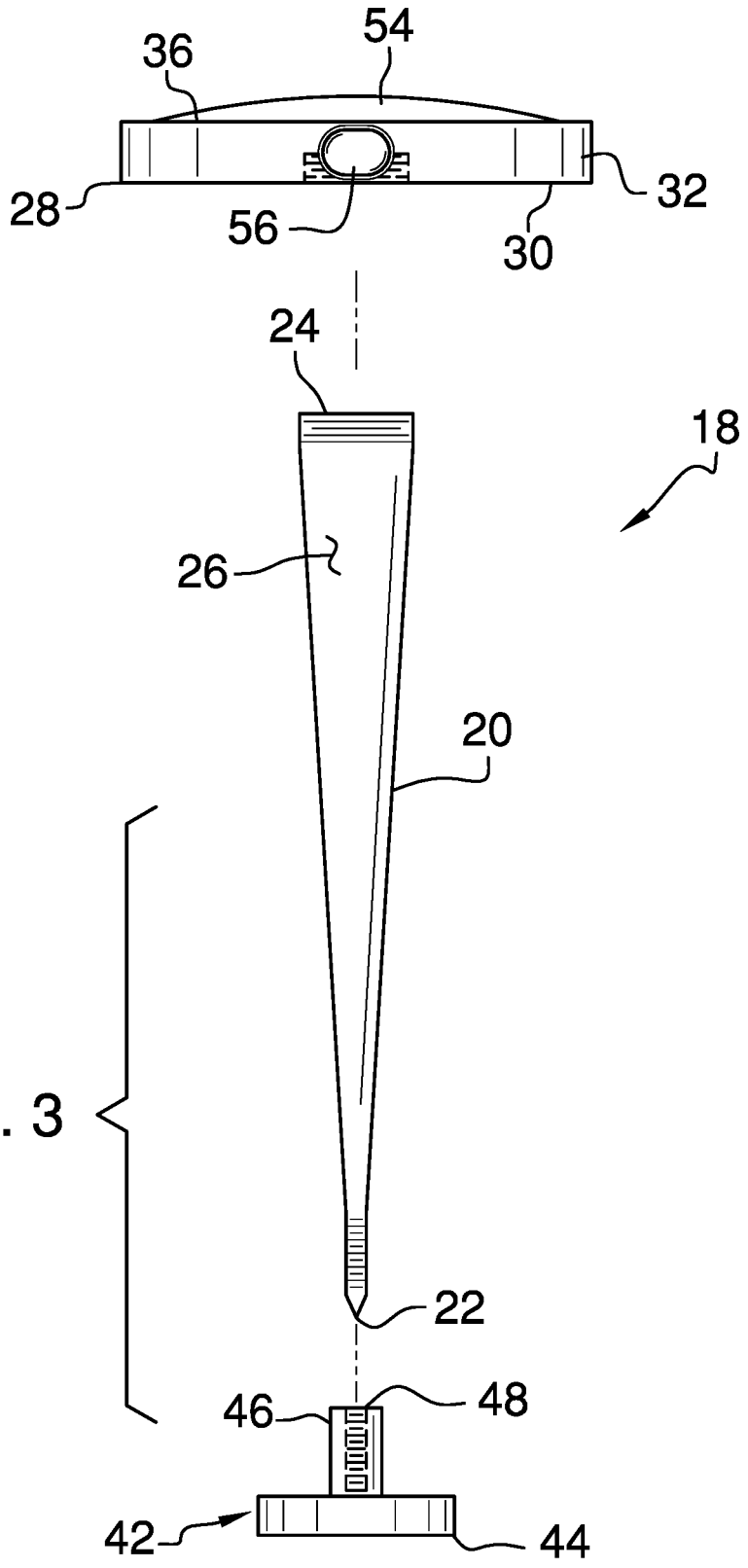
FIG. 3 is an exploded perspective view of an embodiment of the disclosure.
Figure 4:
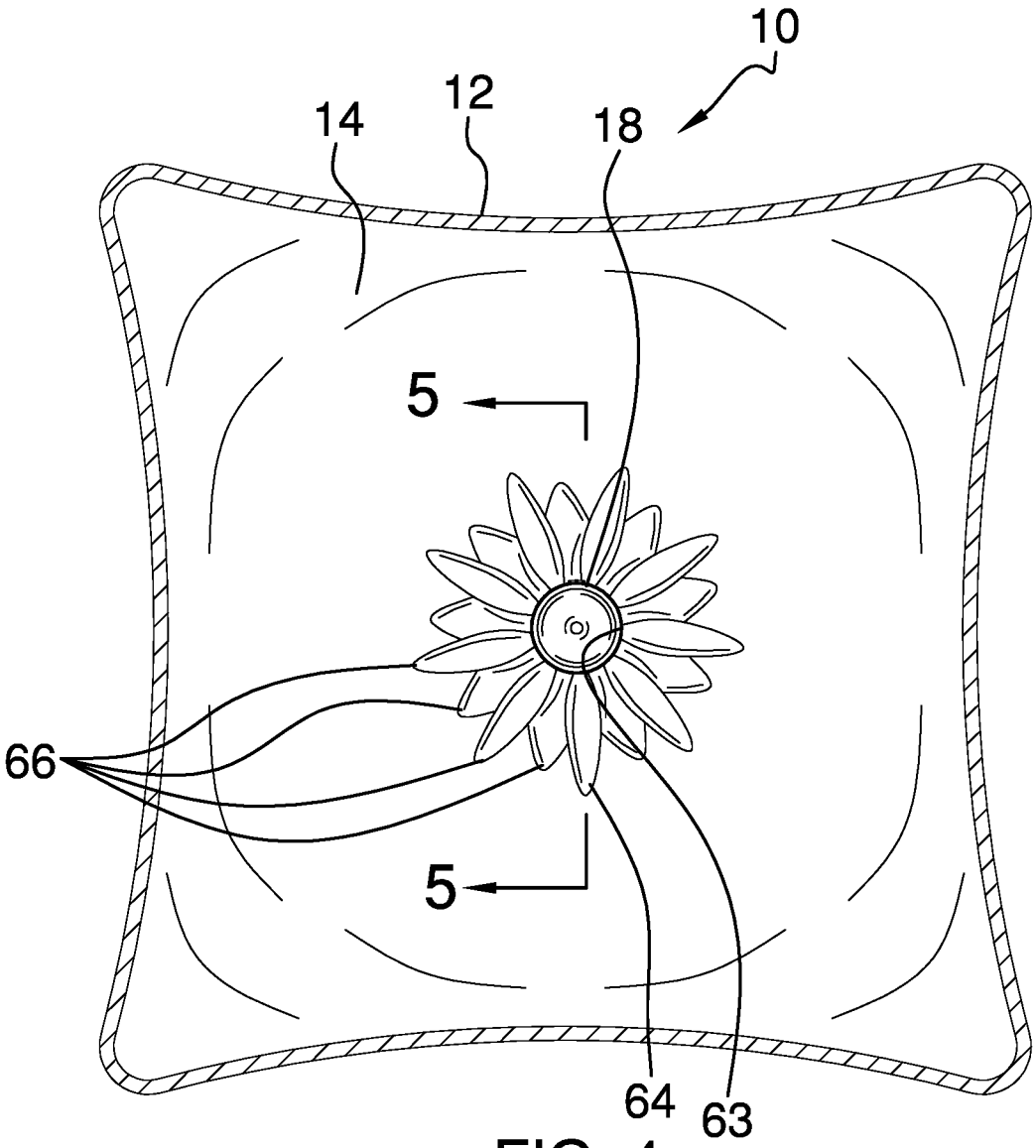
FIG. 4 is a perspective in-use view of an embodiment of the disclosure.
Figure 5:
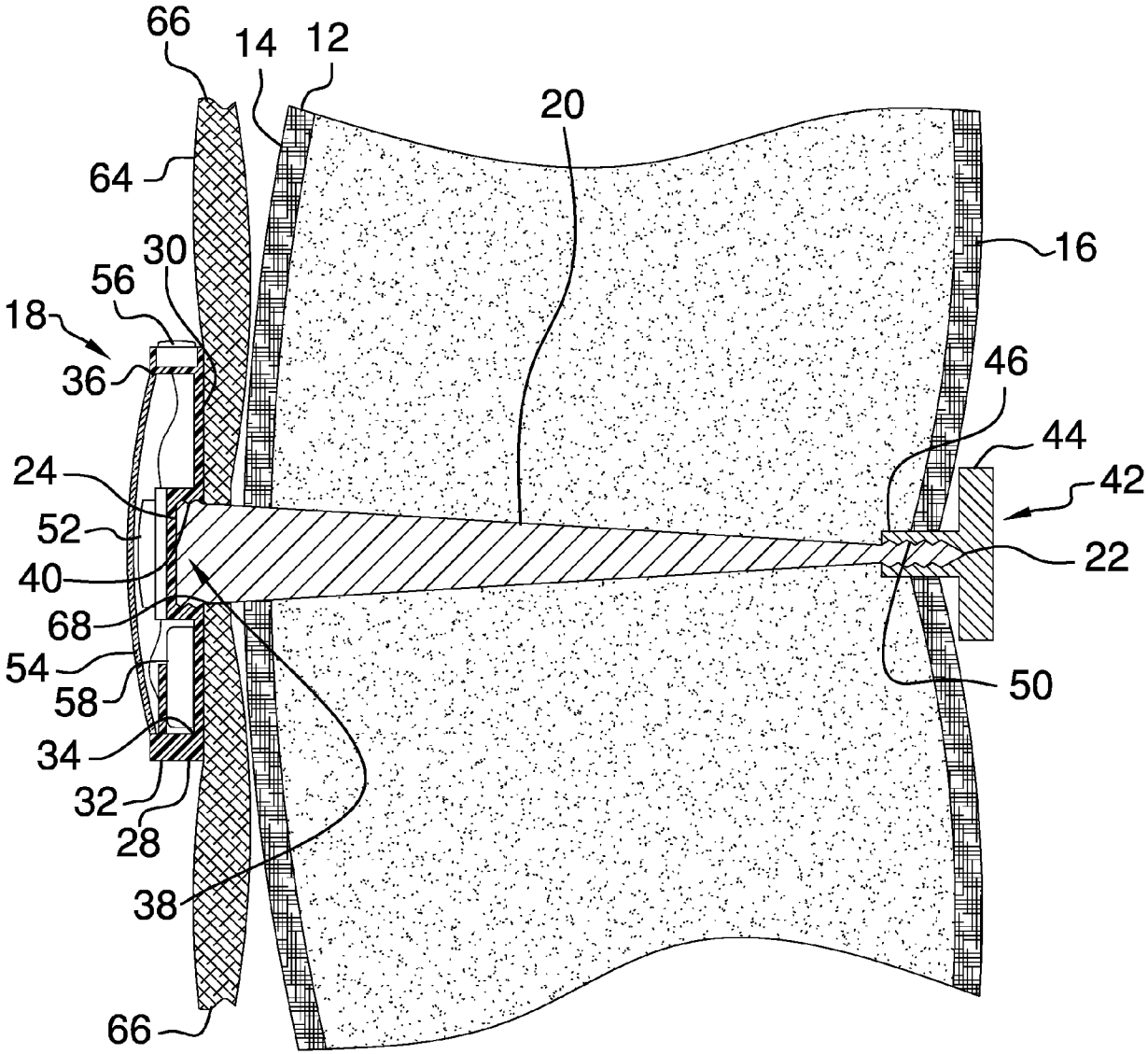
FIG. 5 is a cross sectional view taken along line 5-5 of FIG. 4 of an embodiment of the disclosure.

With reference now to the drawings, and in particular to FIGS. 1 through 6 thereof, a new decoration device embodying the principles and concepts of an embodiment of the disclosure and generally designated by the reference numeral 10 will be described.

As best illustrated in FIGS. 1 through 6, the pillow decoration system 10 generally comprises a pillow 12 that has a front side 14 and a back side 16. The pillow 12 may comprise a throw pillow, a furniture cushion or other pillow. A lighting unit 18 is removably coupled to the pillow 12. Thus, the lighting unit 18 enhances an ornamental appearance of the pillow.

The lighting unit 18 comprises a stem 20 that has a first end 22, a second end 24 and an outer surface 26 extending between the first end 22 and the second end 24. The outer surface 26 tapers to a point between the second end 24 and the first end 22. The outer surface 26 is threaded adjacent to the first end 22 and the outer surface 26 is threaded adjacent to the second end 24. The first end 22 is extended through the front side 14 of the pillow 12 such that the first end 22 extends outwardly through the back side 16 of the pillow 12.

A disk 28 is provided that has a back wall 30 and a peripheral wall 32 extending away from the back wall 30. The peripheral wall 32 is coextensive with an outer edge 34 of the back wall 30 and the peripheral wall 32 has a distal edge 36 with respect to the back wall 30. The back wall 30 has a well 38 extending inwardly therein and the well 38 has a bounding surface 40.

The well 38 receives the second end 24 of the stem 20. The outer surface 26 of the stem 20 threadably engages the bounding surface 40. Thus, the disk 28 is removably coupled to the stem 20. The back wall 30 of the disk 28 abuts the front side 14 of the pillow 12 when the stem 20 is inserted through the pillow 12.

A coupler 42 is provided. The coupler 42 includes a platter 44 and a sleeve 46 extending away from the platter 44. The sleeve 46 has a distal end 48 with respect to the platter 44. The distal end 48 is open and the sleeve 46 has an inner surface 50. The distal end 48 insertably receives the first end 22 of the stem 20 when the stem 20 is extended through the pillow 12. Thus, the platter 44 abuts the back side 16 of the pillow 12. The first end 22 threadably engages the inner surface 50 such that the coupler 42 is removably coupled to the stem 20. The platter 44 retains the stem 20 in the pillow 12.

A light emitter 52 is positioned in the disk 28. The light emitter 52 emits light outwardly from the disk 28. The light emitter 52 may comprise an LED or the like. A lens 54 is coupled to the distal edge 36 of the disk 28 such that the lens 54 covers the light emitter 52. The lens 54 is comprised of a translucent material. Thus, the lens 54 allows the light to pass through the lens 54.

A switch 56 is coupled to the peripheral wall 32 and the switch 56 may be manipulated. The switch 56 is electrically coupled to the light emitter 52 such that the switch 56 turns the light emitter 52 on and off. A power supply 58 is positioned within the disk 28 and the power supply 58 is electrically coupled to the switch 56. The power supply 58 comprises at least one battery. A battery cover 60 is removably positioned on the back wall 30 of the disk 28. The power supply 58 is positioned beneath the battery cover 60.

A decoration 64 is provided and the decoration 64 may be selectively positioned on the lighting unit 18. Thus, the decoration 64 may enhance an ornamental appearance of the pillow 12. The decoration 64 has a plurality of petals 66 radiating outwardly from a central hub 68. The central hub 68 has the second end 24 of the stem 20 extending therethrough. Thus, the decoration 64 is positioned between the front side 14 of the pillow 12 and the disk 28 when the stem 20 is extended through the pillow 12. The decoration 64 may have the appearance of a flower or the like.

Figure 6:
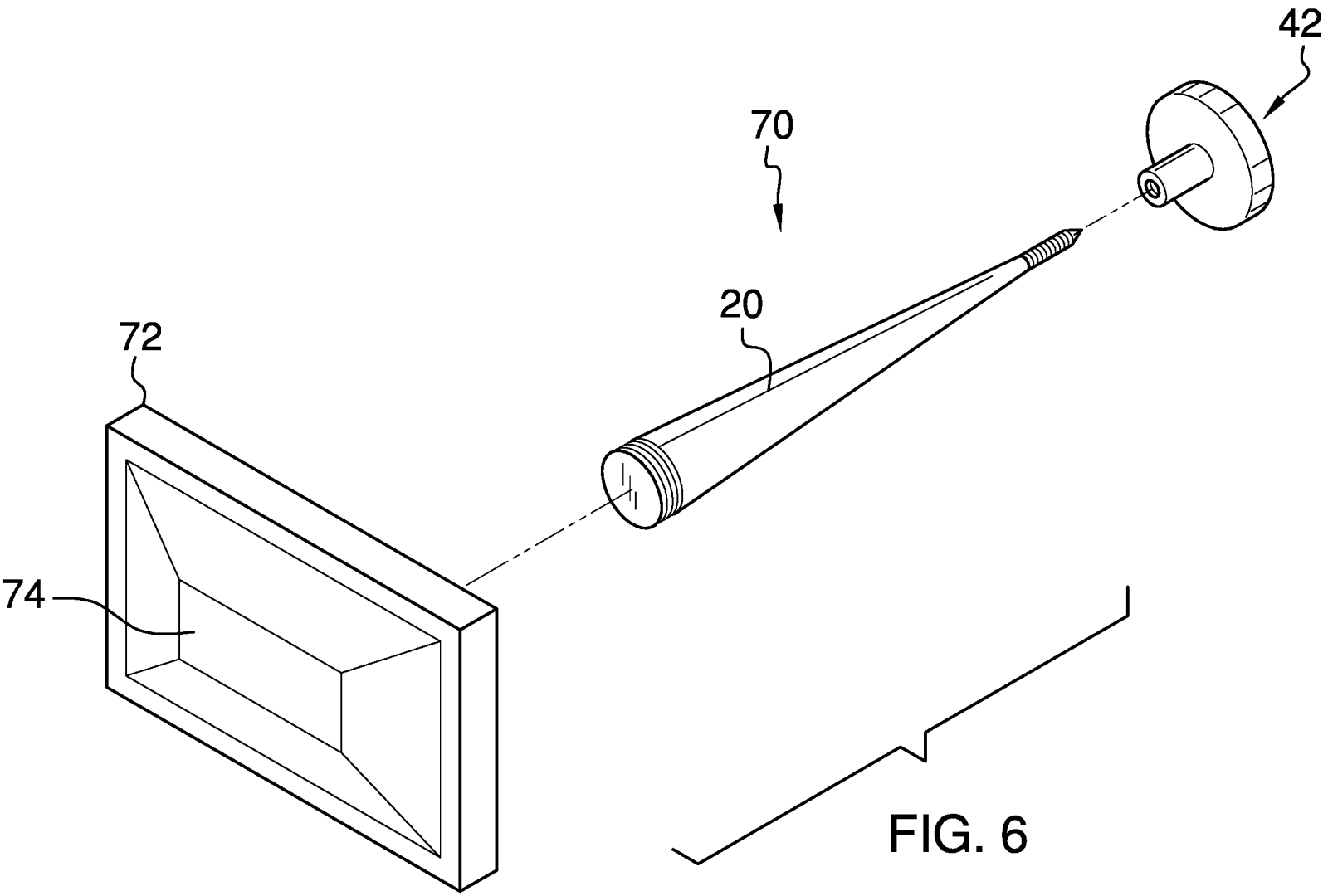
FIG. 6 is an exploded perspective view of an alternative embodiment of the disclosure.

In an alternative embodiment 70 as shown in FIG. 6, a panel 72 may be provided. The panel 72 is removably coupled to the second end 24 of the stem 20 when the stem 20 is extended through the pillow 12. The panel 72 has a front side 74 and the front side may comprise a rhinestone or other decorative gem. The panel 72 may have a rectangular shape.

In use, the stem 20 is extended through the pillow 12 and the coupler 42 is removably coupled to the first end 22 of the stem 20. The decoration 64 may be placed around the second end 24 of the stem 20 and the disk 28 is removably coupled to the second end 24. The disk 28 is coupled to the second end 24 of the stem 20. The switch 56 is manipulated to turn the light emitter 52 on. Thus, the light emitter 52 enhances an ornamental appearance of the pillow 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pillow decoration system comprising:

a pillow having a front side and a back side;

a lighting unit being removably coupled to said pillow wherein said lighting unit is configured to enhance an ornamental appearance of said pillow, wherein said lighting unit comprises a stem having a first end, a second end and an outer surface extending between said first end and said second end, said outer surface tapering to a point between said second end and said first end, wherein said outer surface being threaded adjacent to said first end, said outer surface being threaded adjacent to said second end, said first end being extended through said front side of said pillow such that said first end extends outwardly through said back side of said pillow; and a decoration being selectively positioned on said lighting unit wherein said decoration is configured to enhance an ornamental appearance of said pillow.

2. The system according to claim 1, wherein said lighting unit comprises a disk having a back wall and a peripheral wall extending away from said back wall, said peripheral wall being coextensive with an outer edge of said back wall, said peripheral wall having a distal edge with respect to said back wall, said back wall having a well extending inwardly therein, said well having a bounding surface.

3. The system according to claim 2, wherein:

said well receives said second end of said stem, said second end of said stem threadably engaging said bounding surface such that said disk is removably coupled to said stem, said back wall of said disk abutting said front side of said pillow when said stem is inserted through said pillow.

4. The system according to claim 1, wherein said lighting unit comprises a coupler having a platter and a sleeve extending away from said platter, said sleeve having a distal end with respect to said platter, said distal end being open, said sleeve having an inner surface.

5. The system according to claim 4, wherein:

said distal end insertably receives said first end of said stem when said stem is extended through said pillow having said platter abutting said back side of said pillow, said first end threadably engaging said inner surface such that said coupler is removably coupled to said stem, said platter retaining said stem in said pillow.

6. The system according to claim 2, further comprising:

a light emitter being positioned in said disk wherein said light emitter is configured to emit light outwardly from said disk; and a lens being coupled to said distal edge of said disk such that said lens covers said light emitter, said lens being comprised of a translucent material wherein said lens is configured to allow the light to pass through said lens.

7. The system according to claim 6, further comprising:

a switch being coupled to said peripheral wall wherein said switch is configured to be manipulated, said switch being electrically coupled to said light emitter such that said switch turns said light emitter on and off; and a power supply being positioned within said disk, said power supply being electrically coupled to said switch, said power supply comprising at least one battery.

8. The system according to claim 1, further comprising:

a disk; and wherein said decoration has a plurality of petals radiating outwardly from a central hub, said central hub having said second end of said stem extending therethrough such that said decoration is positioned between said front side of said pillow and said disk when said stem is extended through said pillow.

9. A pillow decoration system comprising:

a pillow having a front side and a back side;

a lighting unit being removably coupled to said pillow wherein said lighting unit is configured to enhance an ornamental appearance of said pillow, said lighting unit comprising: a stem having a first end, a second end and an outer surface extending between said first end and said second end, said outer surface tapering to a point between said second end and said first end, said outer surface being threaded adjacent to said first end, said outer surface being threaded adjacent to said second end, said first end being extended through said front side of said pillow such that said first end extends outwardly through said back side of said pillow, a disk having a back wall and a peripheral wall extending away from said back wall, said peripheral wall being coextensive with an outer edge of said back wall, said peripheral wall having a distal edge with respect to said back wall, said back wall having a well extending inwardly therein, said well having a bounding surface, said well receiving said second end of said stem, said second end of said stem threadably engaging said bounding surface such that said disk is removably coupled to said stem, said back wall of said disk abutting said front side of said pillow when said stem is inserted through said pillow, a coupler having a platter and a sleeve extending away from said platter, said sleeve having a distal end with respect to said platter, said distal end being open, said sleeve having an inner surface, said distal end insertably receiving said first end of said stem when said stem is extended through said pillow having said platter abutting said back side of said pillow, said first end threadably engaging said inner surface such that said coupler is removably coupled to said stem, said platter retaining said stem in said pillow, a light emitter being positioned in said disk wherein said light emitter is configured to emit light outwardly from said disk, a lens being coupled to said distal edge of said disk such that said lens covers said light emitter, said lens being comprised of a translucent material wherein said lens is configured to allow the light to pass through said lens, a switch being coupled to said peripheral wall wherein said switch is configured to be manipulated, said switch being electrically coupled to said light emitter such that said switch turns said light emitter on and off, and a power supply being positioned within said disk, said power supply being electrically coupled to said switch, said power supply comprising at least one battery; and a decoration being selectively positioned on said lighting unit wherein said decoration is configured to enhance an ornamental appearance of said pillow, said decoration having a plurality of petals radiating outwardly from a central hub, said central hub having said second end of said stem extending therethrough such that said decoration is positioned between said front side of said pillow and said disk when said stem is extended through said pillow.

* * * * *